United States Patent [19]

Kumar et al.

[11] Patent Number: 4,472,691

[45] Date of Patent: Sep. 18, 1984

[54] POWER DIVIDER/COMBINER CIRCUIT AS FOR USE IN A SWITCHING MATRIX

[75] Inventors: Mahesh Kumar, South Brunswick Township, Middlesex County; Lakshminarasimha C. Upadhyayula, East Windsor, both of N.J.

[73] Assignee: RCA Corporation, New York, N.Y.

[21] Appl. No.: 383,960

[22] Filed: Jun. 1, 1982

[51] Int. Cl.[3] ..... H01P 1/10; H01P 5/12

[52] U.S. Cl. ..... 333/103; 333/104; 333/136; 340/825.91; 307/584

[58] Field of Search ..... 333/101, 103, 104, 124, 333/125, 127, 128, 136, 137; 179/18 GF; 340/825.89, 825.90, 825.91; 307/29, 80, 473, 474, 243, 244, 584

[56] References Cited

U.S. PATENT DOCUMENTS

| | | | |
|---|---|---|---|
| 2,602,856 | 7/1952 | Rumsey | 333/127 |
| 3,085,204 | 4/1963 | Sletten | 325/180 |
| 3,146,357 | 8/1964 | Spallone | 307/244 X |
| 3,255,450 | 6/1966 | Butler | 343/100 |
| 3,480,885 | 11/1969 | Schrank | 333/7 |
| 3,525,995 | 8/1970 | Schroeder | 343/777 |
| 3,781,806 | 12/1973 | Mizushima et al. | 340/166 R |
| 3,833,866 | 9/1974 | Boutelant | 333/7 D |
| 4,028,632 | 6/1977 | Carter et al. | 330/53 |
| 4,165,497 | 8/1979 | Irons | 333/101 |
| 4,197,428 | 4/1980 | Semur et al. | 179/81 GF |
| 4,223,283 | 9/1980 | Chan | 333/109 |
| 4,316,159 | 2/1982 | Ho | 333/104 |
| 4,356,462 | 10/1982 | Bowman | 333/128 |
| 4,399,439 | 8/1983 | Upadhyayula | 333/101 X |

OTHER PUBLICATIONS

"Switching in Space Will Depend on Multibeam Interconnects", *Microwave Systems News*, vol. 12, No. 1, pp. 127–135, Jan. 1982.

*Primary Examiner*—Paul L. Gensler

*Attorney, Agent, or Firm*—J. S. Tripoli; R. L. Troike; R. E. Smiley

[57] ABSTRACT

A one port-to-M port passive signal power divider circuit (or combiner circuit) where $M>2$ and $\neq 2^N$, M and N are integers, includes M - 1 two-way in-phase passive power dividers having a signal delay D through each path in one or more delay devices having delay D. Each output of each two-way power divider is coupled to an input of another power divider, a delay line or an output port, the arrangement being such that the delay through all ports of the power divider are equal. In accordance with a further embodiment of the invention the outputs of a passive power divider are connected to two-way switches using active components. The switches under control of a control circuit are utilized to switch the input signal to the power divider to any one of 2·M output terminals of the switches.

5 Claims, 6 Drawing Figures

POWER DIVIDER/COMBINER CIRCUIT AS FOR USE IN A SWITCHING MATRIX

This invention is concerned with passive power dividers or combiners and more particularly with such dividers or combiners wherein the division or combination is other than $2^N$ ways.

In signal switching matrix circuits such as for use in communication satellites it is known to use switches containing active devices. See, for example, U.S. patent application Ser. No. 324,027 filed Nov. 23, 1981 by L. C. Upadhyayula, now U.S. Pat. No. 4,399,439 issued Aug. 16, 1983. For a small matrix such as a 10 by 10 such switches are ideal in that not only is there no signal loss but due to the amplification possible with active devices there can actually be a signal gain through the matrix. However, the circuitry becomes both too complex and too costly for a large switch matrix such as 100 by 100.

It is also known to use passive signal power dividers and passive signal power combiners. (Power dividers and power combiners are typically structurally the same.) The power dividers divide the input power M ways each with $1 \div M$ of the input power. The various outputs of the power divider are then coupled to switching devices such as PIN diodes or dual gate FETs which do the actual switching. In the prior art M is limited to such values as are computed by the formula $2^N$, where N is an interger. Furthermore, given the typical input values of power, N is limited to a relatively small value such as 3 or 4 so that M may be at most 16 to allow for a reasonable output power from each leg of the power divider.

In accordance with a preferred embodiment of the present invention, a one port-to-M port signal power divider circuit (or M port-to-1 port power combiner circuit) where $M>2$, $M \neq 2^N$ and M and N are integers comprises a plurality $(M-1)$ of two-way in-phase power dividers each having a signal passage delay $\tau$, and at least one means for delaying a signal by time lapse $\tau$. Each output of each power divider is connected to one of the inputs of another power divider, one of said delay means or an output port such that there is a connection to each output from the output of a power divider or a delay and such that the delay from the input port through the various power dividers and delays to all output ports are the same.

Figure 1:
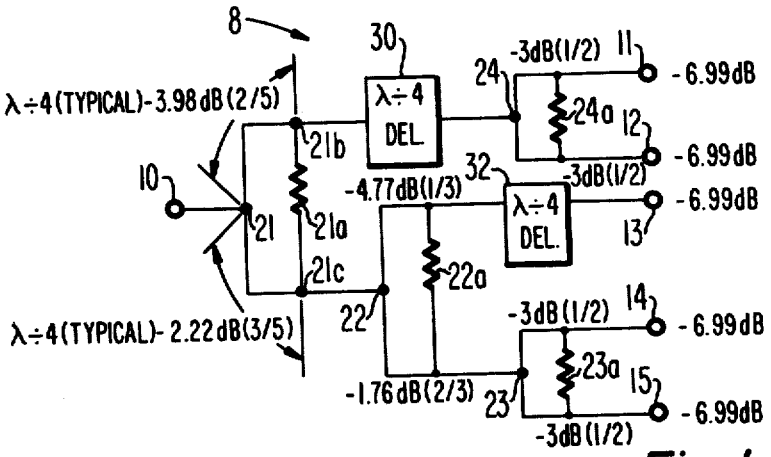
FIG. 1 is a 1-to-5 way passive power divider or 5-to-1 way power combiner in electrical schematic form in accordance with a preferred embodiment of the present invention.

With reference to FIG. 1, an exemplary passive power divider circuit 8 has one input port 10 and five output ports 11–15. The power divider 8 is also a power combiner since the output ports 11–15 can be considered input ports and the input port 10 can be considered an output port. Thus, the term power divider will be understood to include the term power combiner. Power divider 8 may typically be constructed utilizing microstrip technology. Power divider 8 comprises a plurality of in-phase two-way power dividers (or power combiners) illustrated diagramatically as dots 21, 22, 23 and 24. Each power divider is of the type described by Wilkinson in U.S. Pat. No. 3,091,743, which issued May 28, 1963, entitled POWER DIVIDER. Each power divider includes an isolation resistor such as 21*a*, 22*a*, 23*a*, 24*a*. For typical 50 ohm power dividers the value of each resistor is 100 ohms. The delay of signal passage through each leg of each power divider is $\lambda \div 4$, where $\lambda$ is equal to the wavelength of the input signal at the center frequency of operation.

It is essential that the total delay from terminal 10 to each of terminals 11–15 be substantially identical, but because in accordance with the invention the outputs (or inputs in a power combiner) are $\neq 2^N$ there will not be the same number of power dividers in each path from port 10 to ports 11–15. Thus, for example, there are three power dividers in the path from port 10 to ports 14 or 15 but only two power dividers in the path from port 10 to ports 11, 12 and 13. Therefore, in accordance with the invention, delay lines 30 and 32 having delays equal to those in each of the power dividers are incorporated in the circuit as needed to provide the same delay between port 10 and each of ports 11–15. Thus, delay 30 compensates for the one less power divider through the path, for example, from port 10 to port 11 relative to the path, for example, from port 10 to port 14. Likewise, delay 32 compensates for the lack of a power divider at the location of delay 32. The delays 30 and 32 are quarter wave transmission lines at the center frequency of operation.

Assuming for a moment that a six-way power divider circuit is substituted for the five-way power divider circuit of FIG. 1, delay 32 would be replaced by a power divider identical to power dividers 23 and 24 having one output connected to port 13 and another output connected to another terminal (not shown).

Further, if a seven-way power divider circuit is substituted for the five-way power divider circuit of FIG. 1, delay 30 is replaced by a fifth power divider having one output connected to the input of power divider 24 and having a second output connected to another sixth power divider similar to power dividers 23 and 24, the outputs of which go to two additional output terminals (not shown). The total electrical length from port 10 to each of ports 11–15 must be substantially identical. Thus not only are delays such as 30 and 32 necessary but the interconnections between power dividers, delays and ports must be adjusted such as to achieve the identical electrical lengths in all signal paths. This can be achieved by making the electrical lengths between subsequent devices in each path the same. Thus, for example, the electrical length from point 21*b* to delay 30 is the same as the delay from point 21*c* to power divider 22.

With the five-way power divider circuit shown in FIG. 1 the power at each of terminals 11–15 is to be substantially one-fifth that of the power at terminal 10. In general, for an M way power divider circuit at the M ports (output or input) the power is $1 \div M$ that of the single terminal (input or output). Thus assuming a power level at port 10 of unity, the power in decibels and fractions (in parenthesis) is listed at various points throughout the power divider circuit of FIG. 1. From the examination of these figures it will be noted that power dividers 23 and 24 are what might be termed conventional 3dB power dividers producing equal power (actually −3.O1 dB) in both legs.

In contrast, power dividers 21 and 22 produce unequal powers in the two legs and the fractions are different from one power divider to the other. Such power divider circuits as illustrated in FIG. 1 are basic building blocks in switch matrices and can be used, for example, in conjunction with switches such as PIN diodes or dual gate FETs coupled to ports 11–15 to provide structure for a switch matrix. However, matrices using only the power dividers and combiners of FIG. 1 would be limited in size.

Figure 2:
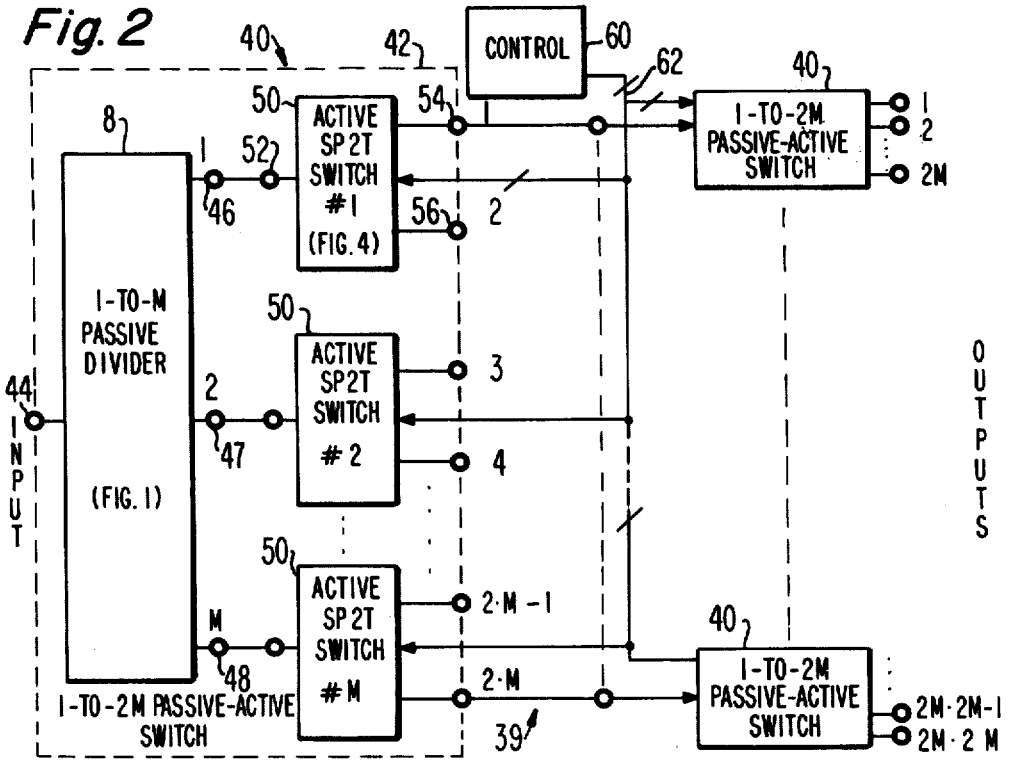
FIG. 2 is a 1-to-$4M^2$ way switch in block diagram form including a plurality of the power dividers in FIG. 1 in series connection with a plurality of two-way switches utilizing active components.

Thus, in accordance with a further aspect of the invention, the circuit of FIG. 2 to which attention is now directed, includes a power divider circuit such as the circuit of FIG. 1 in conjunction with switches utilizing active elements to provide gain as well as signal switching functions. Thus, a 1-to-2M passive-active switch 40 (only one being shown in detail in dash block 42) comprises a 1-to-M way power divider circuit 8 having an input terminal 44 and a plurality of output terminals 1, 2, . . . M (only three legended 46, 47 and 48 being shown) coupled to a like number of active switches 50. Each switch 50 essentially comprises a single-pole double-throw switch having an input terminal 52 and two output terminals 54, 56. Thus, switch 40 has one input terminal and 2·M output terminals.

Figure 4:
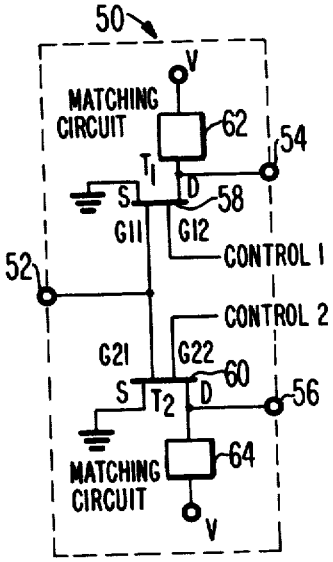
FIG. 4 is a two-way switch in electrical schematic form of the type suitable for use in circuit of FIG. 2.

Each switch 50 may be constructed as illustrated schematically in FIG. 4 to which attention is now directed. Switch 50 typically comprises a pair of depletion type gallium arsenide (GaAs) dual gate MESFET N-channel transistors 58 and 60, also legended $T_1$ and $T_2$. Each transistor has a source terminal (S), a drain terminal (D), a signal gate terminal (G11 and G21 respectively) and a control gate terminal (G12 and G22 respectively). The source terminals are connected to circuit ground. The drain terminals are connected to respective output terminals 54 and 56 and through respective matching networks 62 and 64 to bias source V. The signal gate terminals G11 and G21 are connected together and to switch input terminal 52. The control gate terminals G12 and G22 are connected to sources of control signals indicated by the words CONTROL 1 and CONTROL 2 in FIG. 4.

Operation of switch 50 is as follows. A signal input to terminal 52 from a source not shown but typically of microwave carrier frequency is transmitted to either terminals 54 or 56, both terminals 54 and 56, or neither terminal 54 nor 56 depending on the value of control signals applied to the respective control gates. By a proper choice of value of the CONTROL 1 signal (0 volts for example) the input signal is amplified by transistor $T_1$ and appears at output terminal 54; with another value of CONTROL 1 signal (−5 volts for example) no output signal occurs. Similarly, with a given value of CONTROL 2 signal (0 volts for example) applied to transistor $T_2$, the signal applied at terminal 52 appears at output terminal 56. With a different value of CONTROL 2 signal (−5 volts for example) no output signal occurs at terminal 56. A typical operation would be to have a signal being passed to only one of terminals 54 or 56 or to neither output terminal. Because of the use of the transistors 58 and 60 not only is the path through which the signal flows adjustable but also amplification is provided by the presence of the transistors acting on the signal applied at terminal 52. Thus, the power of a signal appearing at the output of switch 50 may be as great or greater than the power of a signal applied to the power divider.

Returning to FIG. 2, each switch 50 output is connected to an additional passive-active switch 40, similar to that illustrated within block 42. In FIG. 2, assuming that M is 5 it will be understood that the input signal applied at terminal 44 can be directed to any one of 100 output terminals, 1 to . . . $4M^2$ (2M·2M). Switches 50 are controlled by a control circuit 60 coupled via a multiconductor line 62 to each of switches 50 at CONTROL 1 and CONTROL 2 inputs. Control circuit 60, of conventional design, determines which of switch outputs 54 and 56 is passing signals.

Figure 3:
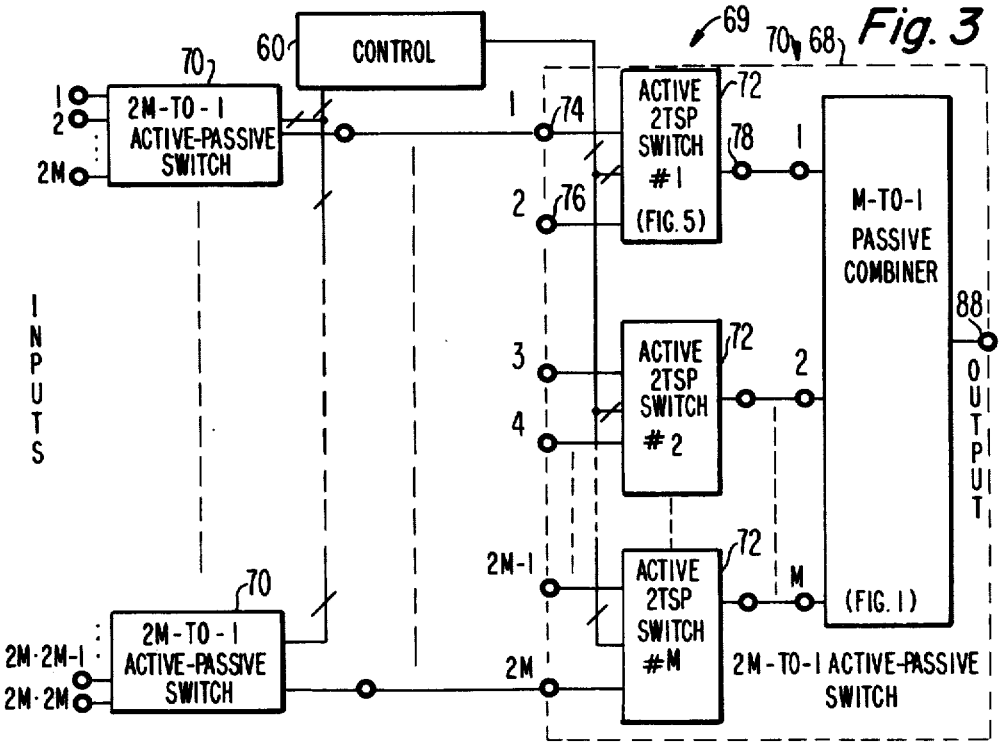
FIG. 3 is a $4M^2$-to-1 way switch in block diagram form including a plurality of power combiners of FIG. 1 and a plurality of two-way switches each utilizing an active component.

A switch matrix also requires a passive-active switch, similar to those illustrated in FIG. 2, for receiving a plurality of signals and for switching those signals to one output terminal. Such an assembly is illustrated in FIG. 3 to which attention is now directed. In dashed block 68, a 2M-to-1 active-passive switch 70 includes an M-to-1 passive combiner circuit 8 and M two-throw single-pole switches 72. M-to-1 passive combiner circuit 8 is the same circuit which was illustrated and described in connection with FIG. 1. The various input terminals 1, 2 . . . M of the combiner circuit 8 are connected to receive signals from a like plurality of active two-throw single-pole switches 72. Each such active switch has input terminals 74 and 76 and output terminal 78.

Figure 5:
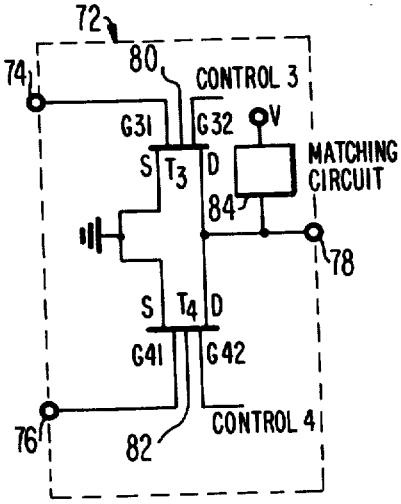
FIG. 5 is a two-way switch in electrical schematic form of the type suitable for use in the circuit of FIG. 3.

These switches are illustrated in detail in FIG. 5 to which attention is now directed. The switches comprise two transistors 80 and 82 also legended $T_3$ and $T_4$. The transistors are identical to those transistors illustrated in FIG. 4. The source (S) terminals of transistors 80 and 82 are connected to circuit ground. The drain (D) terminals of transistors 80 and 82 are connected together to input terminal 78 and through a matching circuit 84 to circuit bias V. A pair of signal gate terminals G31 and G41, respectively, are connected to respective input terminals 74 and 76.

The control gate terminals G32 and G42, respectively, are connected to control inputs from signals legended CONTROL 3 and CONTROL 4. Depending upon the values of the CONTROL 3 and the CONTROL 4 signals, the input at gate 74 or 76 is coupled to terminal 78, no signal is coupled to terminal 78, or, a theoretically possible but not usual situation, signals from both terminals 74 and 76 are coupled to output terminal 78. For example, a CONTROL 3 voltage level of 0 volts provides signal coupling from terminal 74 to terminal 78 while a CONTROL 3 voltage level of −5 volts blocks the signal from terminal 78. Similarly, CONTROL 4 voltage levels of 0 volts and −5 volts provide for signal passing and blockage, respectively, of signals between terminals 76 and 78. Returning to FIG. 3, each of the active switches 72 has coupled to both its input terminals an active-passive switch 70 of the type illustrated within dashed block 68. Assuming again as with the circuit of FIG. 2 that in FIG. 3 M is 5, then what is illustrated is a 100-to-1 switch. Thus, depending on the values of signals applied to the various control terminals of the various active switches, a signal applied at one of the terminals numbered 1 through 2M·2M is coupled to the output terminal 88.

Figure 6:
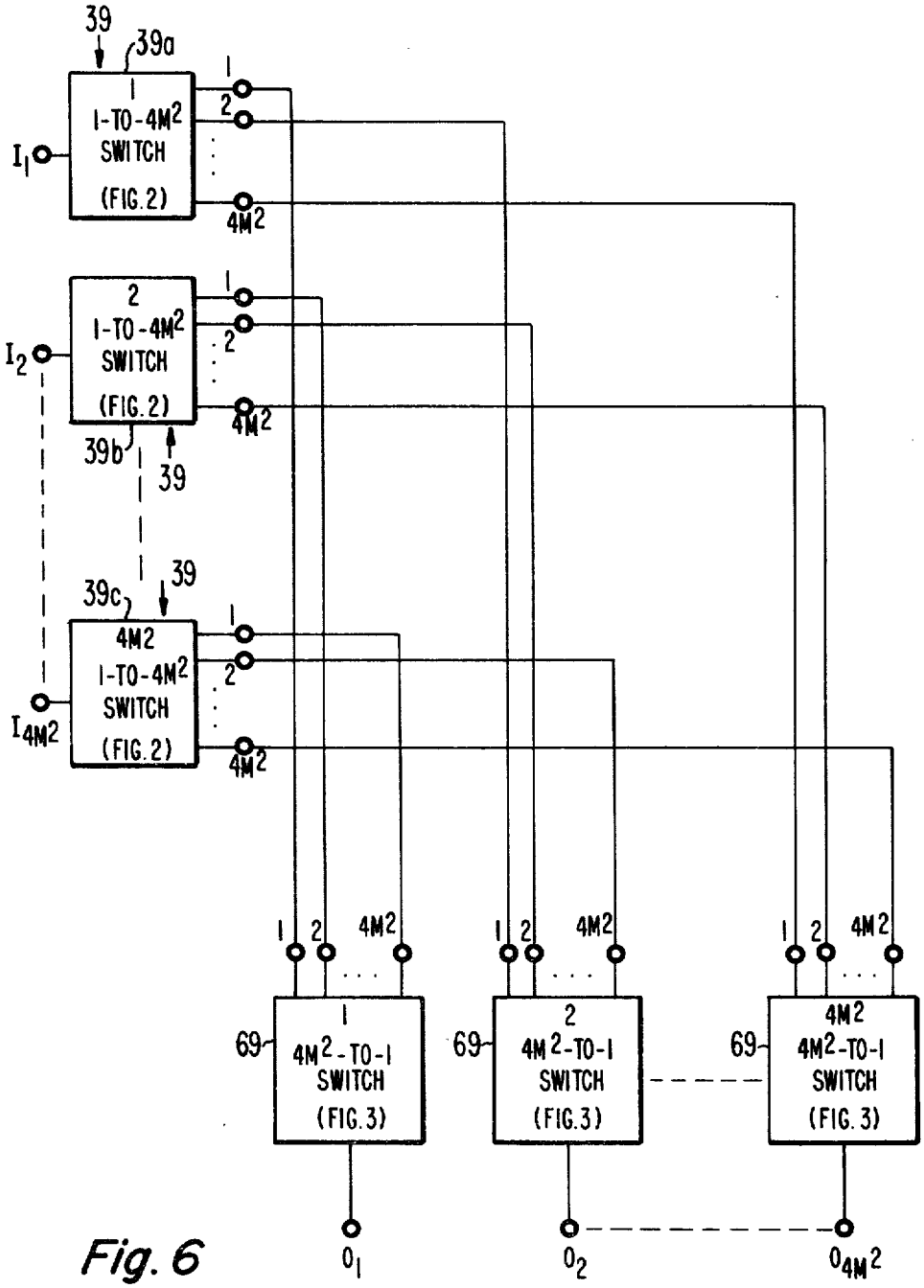
FIG. 6 is a switch matrix utilizing a plurality of the circuits of FIG. 2 and a plurality of the circuits of FIG. 3.

With reference now to FIG. 6 which shows a $4M^2$ by $4M^2$ signal switch matrix, $4M^2$ switches 39 such as illustrated in FIG. 2 are arranged vertically as illustrated in FIG. 6 (only three such as 39 being shown). Likewise, $4M^2$ switches 69 such as shown in FIG. 3 are schematically arranged horizontally in FIG. 6. The switches 39 are connected to $4M^2$ input terminals legended $I_1$, $I_2$, . . . $I_4M^2$. Similarly, switches 69 are coupled to $4M^2$ output terminals legended $O_1$, $O_2$ . . . $O_4M^2$. The $4M^2$ (100 in the example in which M=5) output terminals of the switch 39*a* are connected to respective input terminals (numbered 1) of each of the output switches 69. In similar fashion, the output terminals of the switch 39*b* are connected to terminals (numbered 2) of respective switches 69, etc.

Although not shown in FIG. 6, control signals are applied to each of blocks 39 and 69 as illustrated in FIGS. 2 and 3. By a proper application of control signals to switches 39 and 69 in a manner previously described, a connection can be made from any input terminal to any output terminal. That is, for example, a signal connection can be made from input terminal $I_1$ to output terminal $O_2$. Similarly, an input connection can be made from terminal $I_2$ to output terminal $O_{4M}2$, etc.

Because of the use of active elements in switches 39 and 69 not only is there no loss of signal through the switch matrix illustrated in FIG. 6 but in fact a slight gain can be realized. Furthermore, because of the use of passive power dividers, the number of active switches is reduced to a manageable size while still allowing a relatively large matrix of, for example, 100 by 100.

What is claimed is:

1. A five-way signal passive power divider circuit coupled between an input port and first, second, third, fourth, and fifth output ports, respectively, comprising in combination:

first, second, third, and fourth two-way in-phase power dividers each having an input terminal and first and second output terminals and exhibiting time delay $\tau$ to signal passage through each leg; and first and second delay means each exhibiting time delay $\tau$ to signal passage therethrough;

said first power divider being coupled at its input terminal to said input port and at its first and second output terminals, respectively, to an input of said first delay means and input of said second power divider, said first output of said second power divider being coupled to the input of said second delay means, the output of said second delay means being coupled to said first output port, said second output of said second power divider being coupled to the input of said third power divider, said first and second outputs of said third power divider being coupled, respectively, to said second and third output ports, the output of said first delay means being coupled to the input of said fourth power divider, said output terminals of said fourth power divider being coupled to said fourth and fifth output ports, respectively.

2. A switch arrangement for switching a signal applied at an input terminal to any one or more of a plurality of output terminals comprising, in combination:

means for power dividing an input signal, said input signal received at an input port thereof, into M output signals at M output ports, each of substantially $1 \div M$ the power of the input signal;

M two-way switches, each having an input terminal coupled to a different one of said M output ports and having two output terminals and including amplifying means between said input terminal and each of said output terminals for amplifying signals passing therebetween, the output of at least one of said M two-way switches being coupled to the input of a second said switch arrangement; and control means for switching a signal applied individually to each switch input terminal to neither output terminal thereof, to one output terminal thereof, or to both output terminals.

3. An X by Y signal switching matrix for coupling various ones of Y input lines to various ones of X output lines, where X and Y are integers, comprising in combination:

Y input switch arrangements coupled to said Y input lines where each of said switch arrangements has X outputs;

X Y-throw, single-pole output switches coupled to said X output lines where each of said output switches has Y inputs; and X·Y connections between respective ones of the X outputs of the Y input switch arrangement and respective ones of Y inputs to the X output switches where · is the multiplication symbol;

each of said switch arrangement for switching a signal applied at an input terminal to any one or more of said X outputs comprising, in combination:

means for power dividing an input signal, said input signal received at an input port thereof, into $X \div 2$ output signals at $X \div 2$ output ports, each of substantially $2 \div X$ the power of the input signal;

$X \div 2$ two-way switches, each having an input terminal coupled to a different one of said $X \div 2$ output ports and having two output terminals and including amplifying means between said input terminal and each of said output terminals for amplifying signal passing therebetween; and control means for switching a signal applied individually to each switch input terminal to neither output terminal thereof, to one output terminal thereof, or to both output terminals.

4. A one port-to-M port signal passive power divider circuit, where $M \neq 2^N$, M and N are integers, comprising in combination:

a plurality $M-1$ of two-way in-phase power dividers, having, for each path of signal passage, a signal delay $\tau$, the input of one of said power dividers being coupled to said one port the output signal at each M port being substantially equal to 1:M the power of the input signal at the said one port; and at least one means for delaying a signal passing therethrough by delay $\tau$;

the outputs of X of the $M-1$ power dividers, exclusive of the said one coupled to said one port, being coupled to respective ones of 2X of the M output ports, and, if 2X is less than M, the output of one delay means being coupled to the remaining one of M output ports, where X=integer of $M \div 2$;

each output of the remaining $M-X-1$ of said in-phase power dividers being coupled to a different one of an input of another of said in-phase power dividers or to one of said delay means;

the output of each said delay means exclusive of any one coupled to an output port being coupled to a different one of the input to ones of said in-phase power dividers that are not otherwise connected, such that there is a signal path from said input port to each of said M output ports and the delays through the various signal paths are substantially identical.

5. The combination as set forth in claim 4 wherein each said in-phase power divider includes means for delaying the signal passage by one-quarter wavelength and wherein said delay means is a quarter wavelength delay line.

* * * * *